United States Patent [19]

Boegeman

[11] 4,214,783

[45] Jul. 29, 1980

[54] POSITIVE LOCKING DEVICE

[76] Inventor: Arthur V. Boegeman, 902 Del Paso Blvd., Space 95, Sacramento, Calif. 95815

[21] Appl. No.: 908,950

[22] Filed: May 24, 1978

[51] Int. Cl.[2] ..... E05C 1/04; E05C 13/02

[52] U.S. Cl. ..... 292/150; 292/148; 292/DIG. 60

[58] Field of Search ..... 292/145, 148, 149, 150, 292/151, 175, 179, 189, DIG. 44, DIG. 60, DIG. 13, 2; 70/461, 134, 129, 150

[56] References Cited

U.S. PATENT DOCUMENTS

| | | | |
|---|---|---|---|
| Re. 15,937 | 10/1924 | Fritts | 292/148 |
| 305,294 | 9/1884 | Corn | 292/150 X |
| 671,792 | 4/1901 | Comber | 292/DIG. 60 |
| 985,727 | 2/1911 | Connolly | 292/2 X |
| 1,047,315 | 12/1912 | Shone | 292/148 X |
| 1,176,407 | 3/1916 | Shirey | 292/148 X |
| 2,546,149 | 3/1951 | Bowzer | 292/150 X |
| 3,599,453 | 8/1971 | Bauernfeind | 292/148 X |
| 4,136,540 | 1/1979 | Coralli et al. | 70/134 X |

FOREIGN PATENT DOCUMENTS

| | | | |
|---|---|---|---|
| 128434 | 7/1948 | Australia | 70/129 |
| 70668 | 12/1915 | Austria | 70/461 |
| 213548 | 10/1909 | Fed. Rep. of Germany | 292/148 |
| 9966 | of 1887 | United Kingdom | 292/150 |
| 192314 | of 1923 | United Kingdom | 292/150 |
| 495614 | 11/1938 | United Kingdom | 292/148 |

*Primary Examiner*—Roy D. Frazier
*Assistant Examiner*—Carl F. Pietruszka
*Attorney, Agent, or Firm*—Francis X. LoJacono

[57] ABSTRACT

A positive locking device for mounting to lightweight structures and doors, such as found in mobile homes, wherein the device comprises a bar-locking assembly which is mounted to a door, and includes a bar-receiving frame section generally mounted to a fixed structure associated with the door to be locked. The bar locking assembly includes a mounting plate having a sleeve to slidably receive an elongated bar therethrough, the bar including a longitudinal adjustable head member and a plurality of aligned holes to receive separate locking devices, whereby the bar is locked from longitudinal movement after the bar is received in the bar-receiving frame member.

1 Claim, 3 Drawing Figures

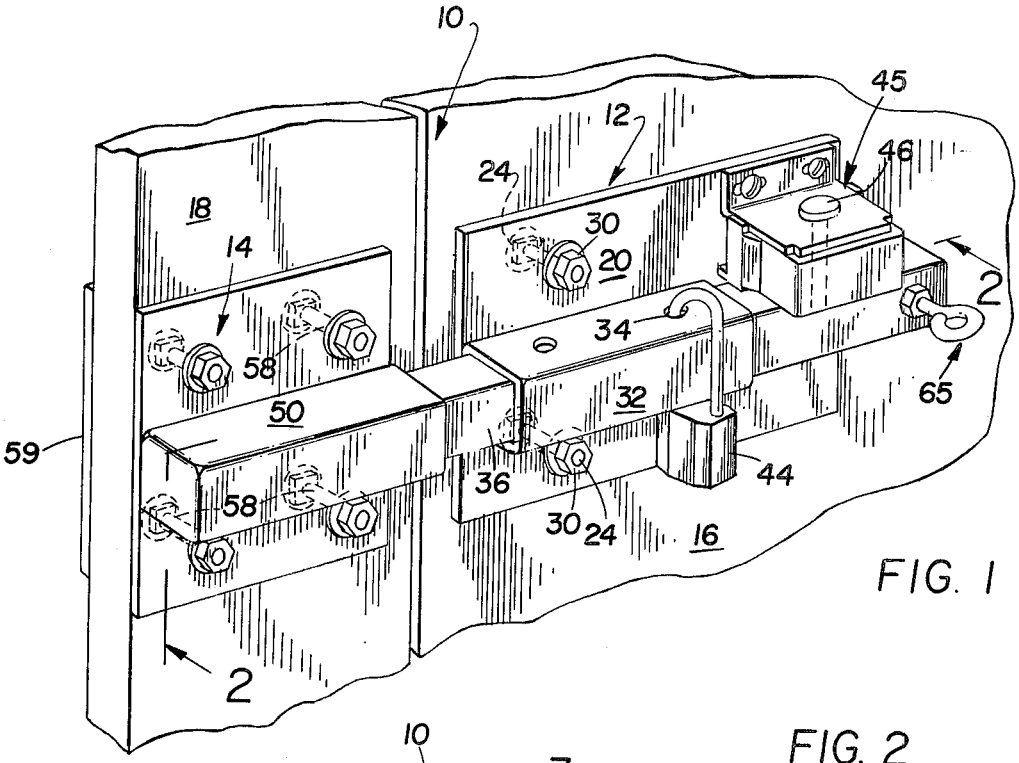
FIG. 1
FIG. 2
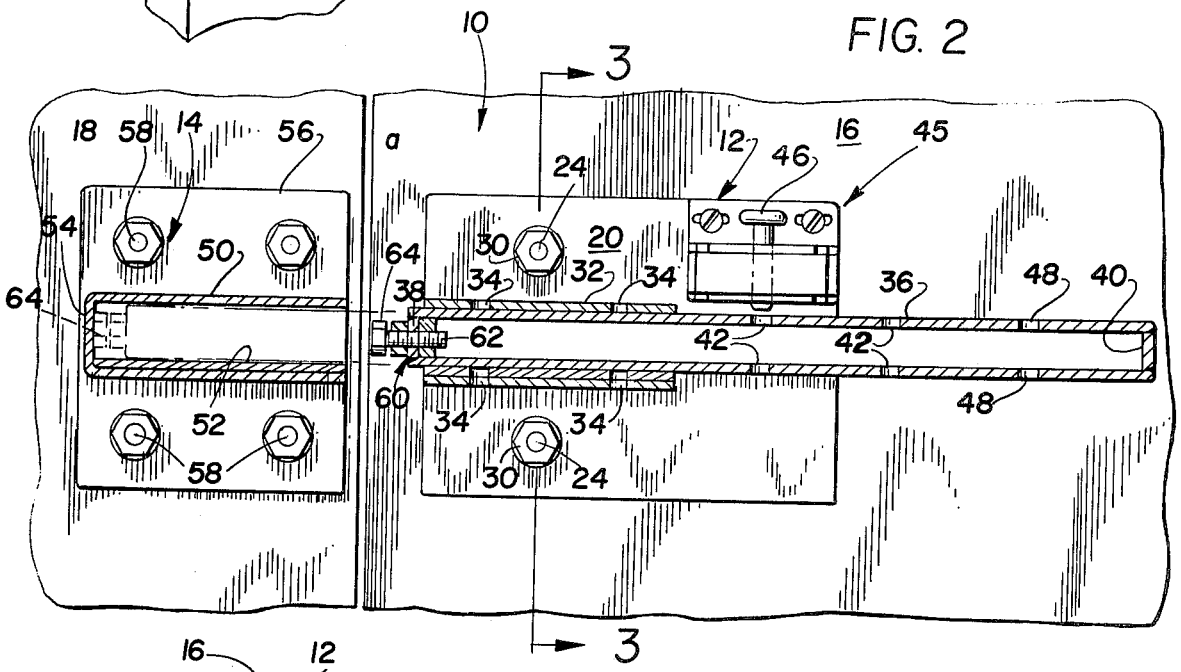
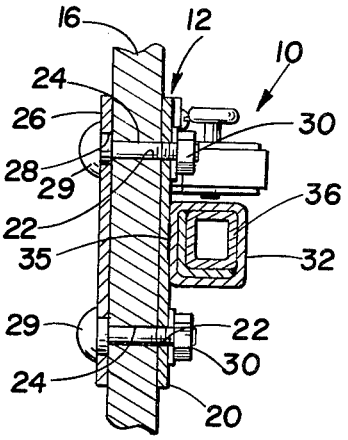
FIG. 3

POSITIVE LOCKING DEVICE

BACKGROUND OF THE INVENTION

1. Field of the Invention

This invention relates generally to locked and latching devices, and more particularly to a locking device that is employed with lightweight structures found in the construction of mobile homes.

2. Description of the Prior Art

As is well known in the art, various problems and difficulties are encountered in providing suitable means for locking doors in order to prevent unwanted intrusion into mobile homes. It has been found that, in mobile-home construction, the rear doors are constructed in such a manner that the average known locking devices are not adequately designed to prevent doors from being opened by those intent with illegal entry.

Due to the particular arrangement of the door structures and the regulations for the construction of this type of mobile building, a more positive locking device is needed. Thus, the applicant herein discloses a locking device specifically designed to overcome the present security problems associated with mobile housing.

SUMMARY OF THE INVENTION

The present invention is arranged to be latched in a positive manner to prevent it from being broken or disengaged from any type of lightweight structure on which it might be mounted.

Accordingly, there is disclosed herein a positive locking device having a locking assembly that is mounted to a door structure, and a bar-receiving frame section that is generally mounted to the adjacent wall structure of the door. The bar receiving section comprises a fixed plate having a longitudinal keeper-sleeve member, wherein one end thereof is opened to receive the slidable bar member of the locking assembly and the opposite end thereof is closed by a wall-stop member.

The slidable bar is part of the locking assembly which further includes a bar sleeve affixed to a mounting-plate member adapted to receive a plurality of mounting bolts therethrough. The bar sleeve is provided with a set of aligned holes to match corresponding holes disposed in the locking bar, whereby a separate locking device can be arranged to be received through the aligned holes, thus preventing the locking bar from being longitudinally moved out of engagement with the keeper sleeve.

The forward end of the locking bar is also provided with an adjustable head member to allow for adjustments between the locking bar and the keeper.

When required, an additional safety-latching mechanism is mounted to the locking-assembly plate, so as to engage the rear area of the locking bar.

OBJECTS AND ADVANTAGES OF THE INVENTION

The present invention has for an important object a provision wherein a bar-locking assembly and the bar-receiving section can be readily adjusted in relationship to each other, due to the variance in their locations.

It is another object of the invention to provide a locking bar that includes an adjustable head member to allow for the variance in the location of the assembly.

It is still another object of the invention to provide a locking assembly which is easily adjustable and mountable to the average lighweight structures generally found in the mobile-home construction industry.

It is a further object of the invention to provide a positive locking device that can accommodate additional latching devices to provide a positive security apparatus heretofore not possible due to the limitations of various known locking devices.

It is still a further object of the invention to provide a device of this character that is easy to operate and maintain.

Still another object of the invention is to provide a device of this character that is relatively inexpensive to manufacture.

It is still a further object of the invention to provide a positive locking device that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective pictorial view of the present invention shown mounted to a door and associated structure;

FIG. 2 is a longitudinal cross-sectional view taken substantially along line 2—2 of FIG. 1, wherein the locking bar is in a released mode; and FIG. 3 is a vertical cross-sectional view taken substantially along line 3—3 of FIG. 2.

DESCRIPTION OF THE PREFERRED EMBODIMENT

Referring more particularly to the drawings, there is shown a positive locking device, generally indicated at 10, the device comprising two sections—the first being referred to as the bar-locking assembly 12, and the second being referred to as the bar-receiving frame section 14. The bar-locking assembly 12 is shown mounted to a structure which represents a lightweight door 16 generally found in mobile homes, and the bar-receiving frame 14 is shown mounted to a stationary structure 18.

It should be noted that this particular locking device has been designed for lightweight structures, particularly the rear doors of mobile homes; and it can be readily understood that it is also suitable for other well-known structures that require a positive locking means.

Accordingly, bar-locking assembly 12 comprises a mounting plate 20, generally having a plurality of holes 22 disposed therein to receive mounting bolts 24. In order to provide a more firm and positive mounting means, there is also included a back plate 26 having matching holes 28 to receive bolts 24.

To further aid in preventing tampering with the assembly, each bolt 24 is provided with a head 29 that can not be engaged by any tools. Bolts 24 are mounted from the inside by nuts 30.

Positioned adjacent the forward edge of plate 20 is a bar-locking support sleeve 32 which extends longitudinally rearward therefrom for a sufficient distance, to allow at least two pairs of holes 34 to be located therein.

Support sleeve 32 can be affixed to plate 20 by any suitable means; however, welding is preferred, such as indicated at 35.

Slidably received in support sleeve 32 is an elongated locking bar 36 which is shown as a hollow-bar stock member having both free ends closed by forward and rearward end walls 38 and 40, respectively. It should also be noted that the inner bore of sleeve 32 is provided with a spacer member when off-the-shelf stock material is used. However, sleeve 32 can be formed to have a size bore identical to that of slide bar 36. Further included in bar 36 are a plurality of matching holes 42. These holes are arranged to align with holes 34 in sleeve 32, as shown in FIG. 1, wherein various other safety-locking means can be employed, such as lock 44. If one is to leave for a considerable length of time, he might want the additional protection by using lock 44.

However, there is still another option provided thereon, wherein a simple releasable-latching means, indicated at 45, is mounted to the mounting plate 20 adjacent the rear thereof. Latching means 45 includes a latch pin 46 which is positioned to be received in larger holes 48 disposed near the rear end of bar 36. FIG. 1 illustrates pin 46 as engaging holes 48, wherein FIG. 2 shows pin 46 in a released position.

Thus, it can be seen that latching bar 36 may be readily moved into engagement with bar-receiving frame section 14 which comprises a keeper sleeve 50 having bore 52 to match bar 36. However, bore 52 is closed at the opposite end by a wall stop 54, thereby limiting the travel of bar 36 in bore 52. Keeper sleeve 50 is also welded to a support plate 56 having a plurality of holes to receive bolts 58, the bolts passing through back plate 59 on the other side of structure 18 (See FIG. 1.).

Due to the different constructions of doors and the associated wall structure, there must be included an adjusting-head means 60 to adjust bar 36 to a proper length. That is, the distance "a", as seen in FIG. 2 (indicated between the bar-latching assembly 12 and the bar-receiving frame section 14), may vary for each installation; and, thus, adjusting means 60 is provided. Means 60 comprises a bolt 62 threadably received in end wall 38 of bar 36, the bolt including head 64 which can be extended or shortened as required, whereby head 64 may be adjusted to engage rear stop wall 54 of keeper sleeve 50, as seen in phantom lines in FIG. 2. This then allows for holes 34 and 42 to still be matched, when bar 36 is fully extended in a locked mode.

A handle means, as indicated at 65, is also attached to bar 36 to allow the bar to be manually moved from one position to another. That is, the bar can be moved from an unlocked mode to a locked mode.

The invention and its attendant advantages will be understood from the foregoing description; and it will be apparent that various changes may be made in the form, construction and arrangement of the parts of the invention without departing from the spirit and scope thereof or sacrificing its material advantages, the arrangement herein before described being merely by way of example; and I do not wish to be restricted to the specific form shown or uses mentioned, except as defined in the accompanying claims.

I claim:

1. A locking device adapted for use with lightweight structures and doors, comprising:

a bar-locking assembly having a first back plate arranged to be mounted to the outer side of a structure; and a first mounting plate arranged to be mounted to the inner locking side of the structure;

a bar-support sleeve affixed to said mounting plate, said bar-support sleeve including a pair of aligned holes therein, and said bar including a pair of aligned holes therein, whereby said holes of said sleeve and said holes of said bar are in respective alignment with each other when said bar is in a locked position;

a slidable, elongated, locking-bar member slidably supported in said support sleeve, said bar member including a plurality of pairs of enlarged aligned holes adjacent one end thereof;

an adjusting-head means mounted to said elongated bar to extend the length of said bar, said head means comprising a bolt member threaded to one end of said bar and having an engaging head formed thereon;

a bar-receiving frame section, including a second back-plate member adapted to be mounted to the outer side of a structure, and a second mounting plate adapted to be mounted to the inner locking side of the structure;

a keeper-sleeve member affixed and positioned on said second mounting plate in longitudinal alignment with said bar, said keeper having an open end to receive said bar and an oppositely disposed closed end defined by a wall, to limit the movement of said bar for engagement with said adjustable head means;

means comprising a plurality of bolts having tamper-proof heads formed thereon, for mounting said plates to said structure, said heads being positioned on the outside of said structure;

a releasable-latching means mounted to said first mounting plate and adapted to be received into said selected enlarged pair of holes when said locking bar is in a locked position, said releasable-latching means including a releasable pin to engage said enlarged holes in said bar.

* * * * *